United States Patent [19]

Traill et al.

[11] 4,258,861

[45] Mar. 31, 1981

[54] SINGLE-PAPER VENDING APPARATUS

[76] Inventors: Philip J. Traill, 123 Pamela Ann Dr., Fort Walton Beach, Fla. 32548; Joe H. Nall, P.O. Box 1093, Crestview, Fla. 32536

[21] Appl. No.: 43,305

[22] Filed: May 29, 1979

[51] Int. Cl.[3] ..... B65H 1/12

[52] U.S. Cl. ..... 221/213; 221/227

[58] Field of Search ..... 221/2, 14, 17, 259, 221/213, 270, 227, 232, 244, 214, 215

[56] References Cited

U.S. PATENT DOCUMENTS

| | | | |
|---|---|---|---|
| 2,612,426 | 9/1952 | Hawks | 221/215 |
| 2,832,506 | 4/1958 | Hatcher | 221/227 X |
| 3,747,733 | 7/1973 | Knickerbocker | 221/244 X |
| 4,139,120 | 2/1979 | Moore | 221/213 |
| 4,140,243 | 2/1979 | Etes | 221/215 |

*Primary Examiner*—Stanley H. Tollberg

*Attorney, Agent, or Firm*—Jones, Thomas & Askew

[57] ABSTRACT

Apparatus for vending papers, such as newspapers, singly therefrom. The apparatus comprises an enclosure having a slot formed therein for dispensing papers, a handle and a coin control mechanism. Papers are stacked vertically in the enclosure on a platform movable in a vertical direction. A cart, movable in a horizontal direction, has friction pads extending therefrom which engage the top paper of the stack of papers and dispense it out of the slot as the cart is pulled across the top of the stack of newspapers by pulling movement of the handle.

3 Claims, 8 Drawing Figures

174
172
170
100
130
98
96
136
90
92
128
94
72
129
108
138
80
106
104
72
70
190
72
164
154
146
144
166
162
160
142
163'
163
140
78
180
116
114
16
112
80
178
186
176
30
184
76
188
189
182
74
40

SINGLE-PAPER VENDING APPARATUS

FIELD

The present invention relates to apparatus for vending articles such as newspapers, and more particularly, to such apparatus for vending a single copy of a paper.

BACKGROUND

Many different apparatus are known for vending newspapers. Typical of such apparatus is an enclosure for containing a stack of newspapers. The enclosure often has a door which may be opened by inserting the proper amount of coins into a coin control mechanism. When the door is opened, however, the entire stack of newspapers usually becomes accessible. As a result, unpaid-for newspapers are often stolen from such apparatus.

The problem of theft losses from such apparatus has been recognized and various apparatus developed to deal with the problem. See for example U.S. Pat. Nos. 2,816,688; 3,082,912; 3,114,475; 3,158,248; 3,180,518; 3,253,690; 3,503,481; 3,708,087; 3,747,733 and 3,749,281 (all incorporated herein by reference). Such apparatus, however, has not generally been commercially successful, often due to complexity of design or unreliability or difficulty of operation.

BRIEF DESCRIPTION OF THE INVENTION

Generally, the present invention relates to apparatus for vending single articles such as newspapers. More particularly, the present invention comprises an enclosure for enclosing a plurality of papers. Within the enclosure is a movable platform upon which the papers are to be stacked. The platform is biased upwardly so that as papers are removed from the top of the stack, the platform moves upwardly, thereby maintaining the top paper of the stack in the same position adjacent a movable cart. The movable cart, which is attached to a pull knob on the outside of the enclosure, can be pulled across the top of the stack of papers. As the cart is pulled across the stack of papers, pads attached to the cart engage the top paper and dispense it from a slot in the enclosure. A display paper, which is displayed behind a window in the enclosure is held in place by a releasable bracket underlying the display paper. When the last paper on the platform has been dispensed, forward movement of the cart releases the releasable bracket and permits the display paper to be dispensed by gravity feed from a slot in the enclosure below the window.

Accordingly, it is an object of the present invention to provide improved paper vending apparatus.

Another object of the present invention is to provide paper vending apparatus which vends papers singlely therefrom.

A further object of the present invention is to provide paper vending apparatus which vends a display paper therefrom after all other papers have been vended.

Yet another object of the present invention is to provide paper vending apparatus which prevents unpaid-for papers from being dispensed therefrom.

These and other objects, features and advantages of the present invention will become apparent from a review of the following detailed description of the disclosed embodiment and the appended drawing and claims.

DETAILED DESCRIPTION OF THE DISCLOSED EMBODIMENT

Figure 1:
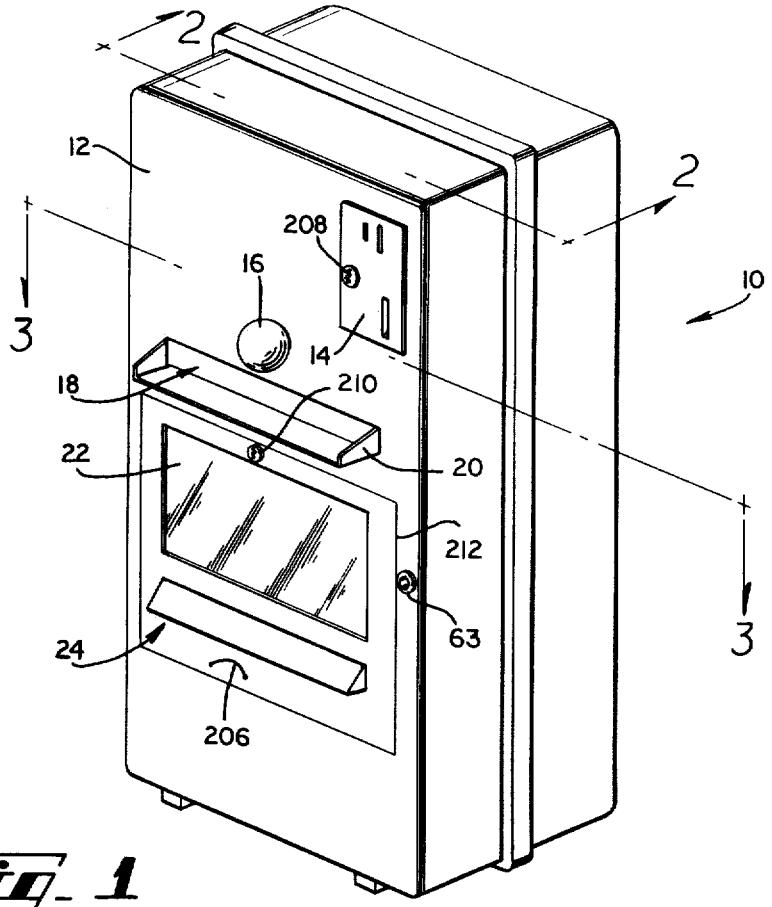
FIG. 1 is a pictorial view of a disclosed embodiment of the paper vending apparatus of the present invention.

Referring now to the drawing in which like numbers indicate like elements throughout the several views, it will be seen that there is an apparatus 10 for vending newspapers. Although the present invention is described as for vending newspapers, it will be understood that other types of multiple page folded paper documents can be dispensed from the apparatus 10. The apparatus 10 comprises an enclosure 12 for containing newspapers and other associated apparatus, a coin control mechanism 14, a puller knob 16, a dispensing slot 18 formed in the enclosure adjacent a dispensing tray 20, a window 22 for displaying a display paper, and a dispensing slot 24 located below the window for dispensing the display paper.

The enclosure 12 can be made of any suitable material which will provide a substantially rigid, durable and weather resistant structure. The enclosure 12 may be advantageously constructed from molded glass fiber reinforced structural plastic. Such material permits high volume production of accurately made parts of high impact, tensile, flexural, compressive and shear strength. It also provides an enclosure which is essentially impervious to moisture and salt spray, and is substantially unaffected by other environmental factors, such as extremes of temperature.

The coin control mechanism 14 is of a type well known in the art. Such mechanisms may be adjusted to sort coins inserted therein to accept a desired monetary amount and, typically, include other features such as coin returns, bent coin rejection and various anti-theft protection devices. A coin control mechanism suitable for use with the present invention is the News Equipment Sales Type LCD made by News Equipment Sales Company of San Leandro, California. Other types of coin control mechanisms may be used in the present invention and the modification of the apparatus to accept other coin control mechanisms is deemed within the skill of the art.

Figure 2:
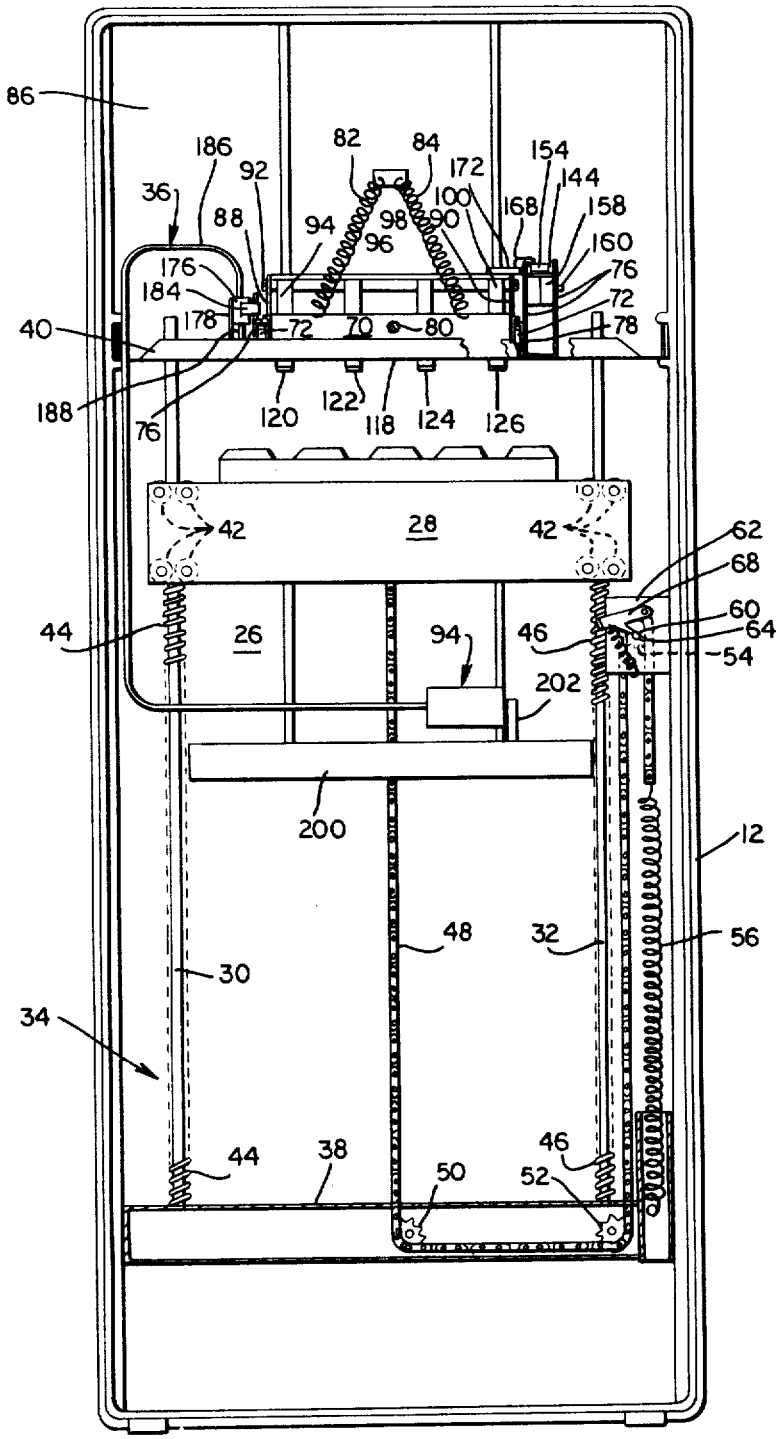
FIG. 2 is a cross-sectional view taken along the line 2—2 of the apparatus shown in FIG. 1.

The enclosure 12 defines a hollow chamber 26, FIG. 2, within which is disposed the mechanical apparatus for dispensing the newspapers contained therein. Disposed in the chamber 26 is a movable platform 28 upon which a plurality of folded newspapers can be stacked. Two rods 30, 32 extend from the lower portion 34 of the chamber 26 to the upper portion 36 of the chamber. The lower ends of the rods 30, 32 are each attached to a bracket 38, and the upper ends of the rods are each attached to a tray 40. The platform 28 is slidably attached to the rods 30, 32 such that the platform may slide up and down on the rods between the bracket 38 and the tray 40. A plurality of roller wheels 42 attached to the platform 28 are provided to facilitate sliding of the platform on the rods 30, 32. Compression springs 44, 46 are provided on each rod 30, 32 between the platform 28 and the bracket 38 so that the platform is urged upwardly toward the tray 40. The springs 44, 46 are sufficiently strong so that when the platform 28 is fully loaded with a stack of newspapers, the springs exert sufficient upward force on the platform to overcome the weight of the newspapers resting on the platform and urge the platform and newspapers upwardly toward the tray 40. The tray 40 also functions as a motion stop for the platform 28.

A mechanism is provided to pull the platform 28 downwardly toward the bracket 38. The mechanism comprises a chain 48, such as a conventional bicycle chain, having one end attached to the bottom of the platform 28. The chain 48 extends downwardly from the platform 28 to a cogged gear 50, transversely to another cogged gear 52, upwardly to yet another cogged gear 54, and downwardly whereupon the other end of the chain 48 is attached to one end of a spring 56 having its other end attached to the bracket 38. The spring 56 is designed to exert a downward force on the chain 48 so that as the platform 28 is lowered toward the bracket 38, the spring retracts the chain.

The cogged gear 54 is mounted on a shaft 60 rotatably attached to a bracket 62. The cogs of the gear 54 engage the links of the chain 48 so that as the shaft 60 and gears are rotated in a clockwise direction, the chain will pull downwardly on the platform 28 and lower it against the force of the springs 44, 46. To facilitate turning of the gear 54 a crank handle (not shown) may be inserted through an aperture 63 (FIG. 1) in the enclosure 12 so as to engage the shaft 60. Pins 64 extending from the shaft 60 engage slots in the crank handle so that rotation of the handle rotates the shaft and the gear 54. A pawl 68 rotatably attached to the bracket 62 can be used to engage the pins 64 so that the shaft 60 is prevented from rotating in a counterclockwise direction. Thus, it will be appreciated that the platform 28 can be lowered and retained in the lowered position for loading by the use of the crank.

Figure 3:
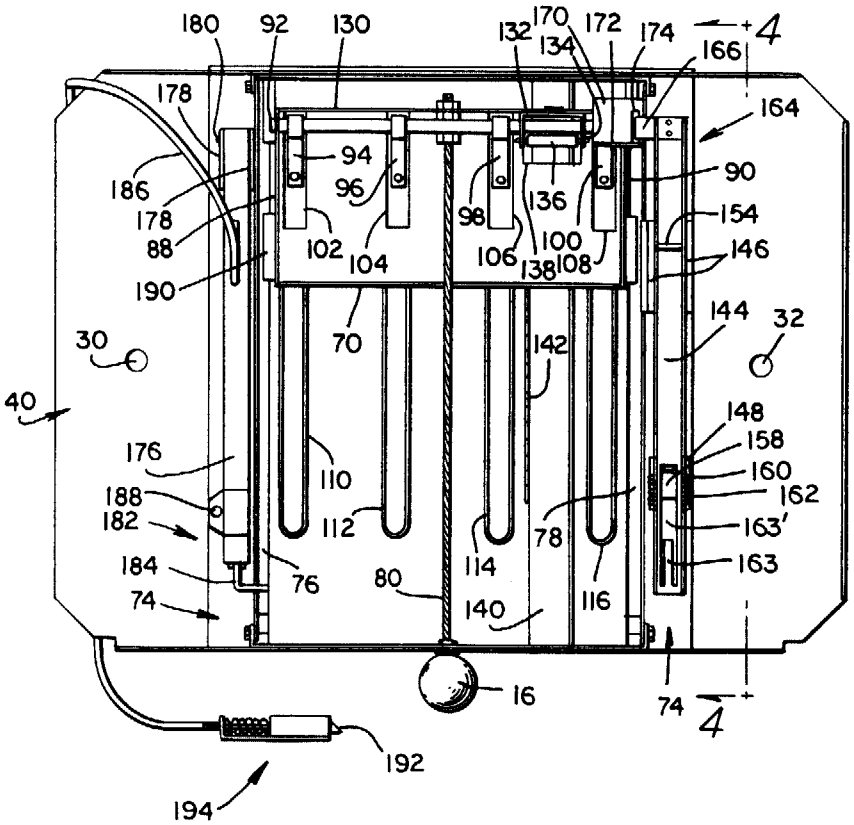
FIG. 3 is a cross-sectional view taken along the line 3—3 of the apparatus shown in FIG. 1. with the enclosure removed for clarity.

Disposed in the upper portion 36 of the chamber 26 is the mechanism for dispensing the top newspaper of a stack of newspapers on the platform 28. The mechanism comprises a puller cart 70 having four wheels 72 attached thereto. A generally rectangular frame member 74 (FIGS. 3 and 8) attached to the tray 40 has attached to its inner sides two track members 76, 78 in which the wheels 72 of the cart 70 roll. Thus, it will be appreciated that the cart 70 can slide forward and backward in a horizontal plane along the length of the tracks 76, 78.

The puller knob 16 disposed on the exterior of the enclosure 12 is attached to a cable 80 which in turn is attached to the puller cart 70. Springs 82, 84 (FIG. 2), each having one end attached to the rear interior wall 86 of the enclosure 12 and the other end attached to the puller cart 70, nominally maintain the puller cart in a position adjacent the rear wall. It will be appreciated that pulling the puller knob 16 causes the puller cart 70 to roll forward from its initial position adjacent the rear wall 86 toward the front of the enclosure, and that when the puller knob is released, the springs return the puller cart to its initial position.

Figure 7:
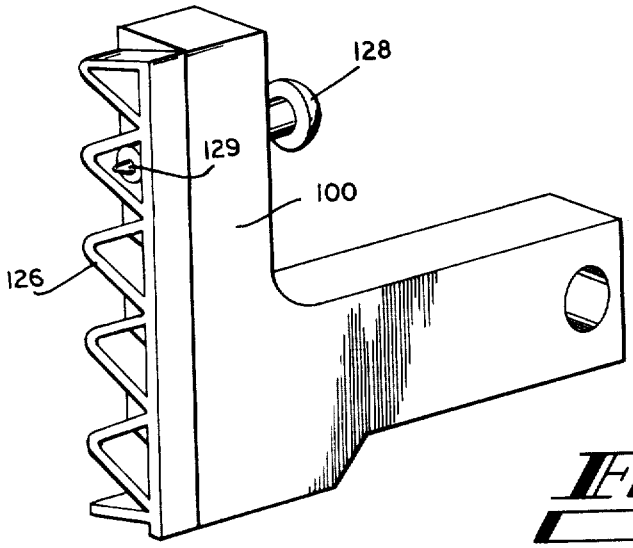
FIG. 7 is a detailed pictorial view of one of the puller pad brackets shown in FIG. 6.
Figure 8:
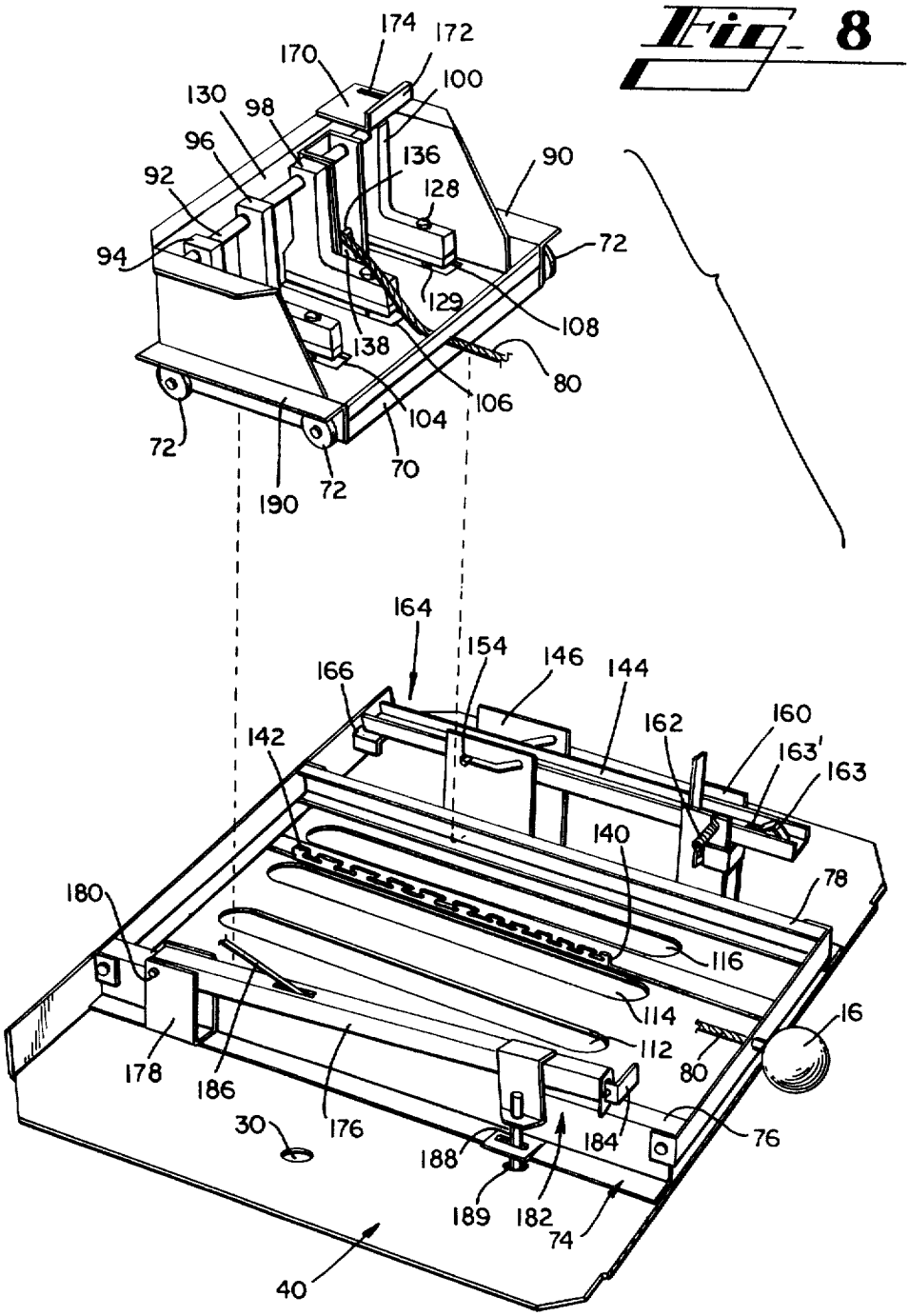
FIG. 8 is a detailed pictorial view of apparatus shown in FIG. 3 with the puller cart exploded away from the tray for clarity.

Attached between two side flanges 88, 90 of the puller cart 70 is a shaft 92. Rotatably attached to the shaft 92 are four L-shaped puller pad brackets 94, 96, 98, 100. The brackets 94–100 extend downwardly through four corresponding slots 102, 104, 106, 108 formed in the cart 70 and four slots 110, 112, 114, 116 formed in the tray 40, so that the lower portion of the brackets extend below the lower surface 118 of the tray. Attached to the lower portion of each of the brackets 94–100 are a plurality of friction pads 120, 122, 124, 126. The friction pads 120–126 are made of a material which will produce a relatively large amount of friction when slid on paper, such as a relatively soft rubber, and are arranged to run diagonally across the width of the brackets 94–100 as best shown in FIGS. 7 and 8.

Disposed adjacent the forward end of each bracket 94–100 is a screw pin 128 (FIG. 7) having a tip 129 which projects from the lower surface of the brackets. Mating threads (not shown) in the screw pin 128 and brackets 94–100 permit the tip 129 to be raised and lowered with respect to the friction pads 120–126 by rotating motion of the screw pin 128. Thus, it will be appreciated that the amount of friction between the friction pads 120–126 and the newspapers can be adjusted by raising and lowering the screw pins 128.

Figure 6:
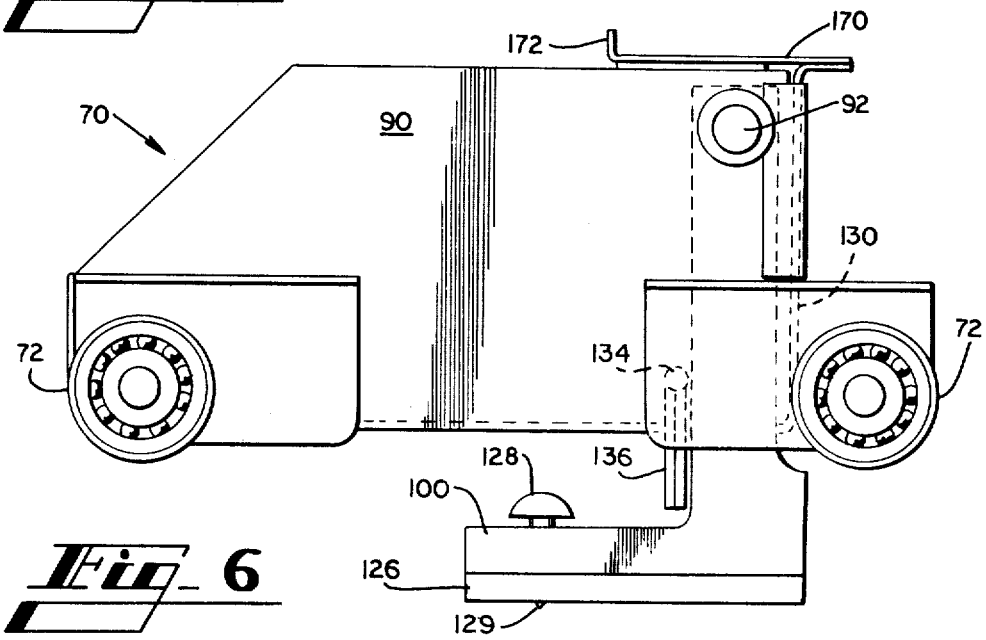
FIG. 6 is a detailed side view of the puller cart shown in FIG. 3.

It will be appreciated by those skilled in the art that the amount of rotation of the brackets 94–100 about the shaft 92 is limited by the rear wall 130 of the puller cart 70. As shown in FIG. 6, the bracket 100 is in contact with the wall 130 so that further counterclockwise rotation of the bracket is prevented. However, the brackets 94–100 are free to rotate in a clockwise direction about the shaft 92 from the position shown in FIG. 6. Therefore, during forward movement of the cart 70, the pads 120–126 frictionally engage paper pressed into contact with the lower surface 118 of the tray 40; but during rearward movement of the cart, the pads will not engage such paper because of the tendency of the brackets 94–100 to rotate about the shaft 92 in a clockwise direction from the position shown in FIG. 6. The brackets 94–100, and their associated friction pads 120–126, therefore, selectively engage paper contacting the lower surface 118 of the tray 40, such as the top newspaper of a stack of papers on the platform 28, depending on the direction in which the cart 70 is moving.

In order to prevent incremental movement of the cart 70 forward and backward, the cart is provided with a two-way ratchet system. Non-rotatably attached to the shaft 92 and the rear wall 130 of the cart 70 is a bracket 132 (FIG. 3) having a second shaft 134 attached thereto. Rotatably disposed on the second shaft 134 is a pawl 136 (FIG. 6) which hangs downwardly from the shaft through a slot 138 formed in the cart 70. A rack 140 (FIGS. 3 and 8) attached to the tray 40 has teeth 142 which project upwardly and selectively engage the pawl 136. It will therefore be appreciated that once the cart 70 has begun to move forwardly, the ratchet system prevents the cart from moving rearward towards its original position until the cart has been pulled its full length of travel so that the pawl 136 disengages the rack teeth 142. At such time, rearward movement of the cart 70 is possible; the pawl 136 engages the teeth 142 and further forward movement of the cart is prevented until the cart is returned to its initial position so that the pawl disengages the rack teeth. This ratchet system prevents small forward and backward movement of the puller cart 70 which could otherwise slowly move the top newspaper forward and dispense it from the slot 18. The cart 70 must be pulled forwardly to its fullest extent before rearward motion is possible. Therefore, dispensing of more than one newspaper is prevented.

Disposed on the frame 74 adjacent the track 78 is a locking lever 144 which cooperates with the coin control mechanism 14 to selectively lock and unlock the cart 70 in its initial position. The locking lever 144 in an elongate member formed in a U-shaped cross-section. The locking lever is pivotally and slidably disposed between two sets of brackets 146, 148 attached to the frame 74. The brackets 146 have J-shaped horizontal slots 150 formed therein and the brackets 148 have straight vertical slots 152 formed therein. A shaft 154 extends through the slots 150 in the brackets 146 and through holes (not shown) in the locking lever 144 so that the lever can pivot about the shaft and the lever and shaft can slide the length of the slot. The forward end 156 of the locking lever 144 is disposed on a wheel 158 (shown in dotted line in FIG. 4) rotatably mounted on a shaft 160 slidably disposed in the slots 152 of the brackets 148. Springs 162 each having one end attached to an end of the shaft 160 and the other end attached to the bracket 148 exert a force on the shaft and urge it upward in the slot 152. Formed adjacent the forward end 156 of the locking lever 144 is a cam surface 163 conveniently formed by punching out of the lever. It will be appreciated that when a downward force is applied to the forward end 156 of the locking lever 144, the forward end of the lever, the wheel 158 and the shaft 160 in the slot 152 will move downwardly while still permitting the lever 144 to slide forwardly on the rotatable wheel.

Figure 4:
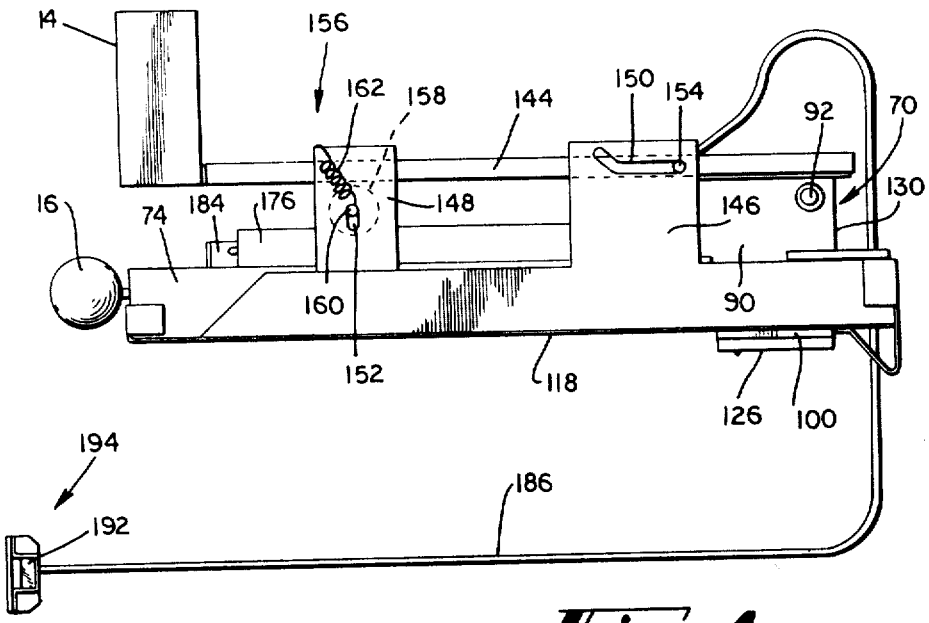
FIG. 4 is a cross-sectional view taken along the line 4—4 of the apparatus shown in FIG. 3.

Disposed adjacent the forward end 156 of the locking lever 144 is the coin control mechanism 14 (FIG. 4). When the lever 144 is in the orientation shown in FIG. 4, forward sliding motion of the lever is substantially prevented by a coin return bracket (not shown) on the coin control mechanism 14. However, when the proper amount of coins has been inserted into the coin control mechanism 14, the coins fall into a position such that the cam surface 163 upon forward motion of the locking lever 144 engages the coins and cams the locking lever downwardly, thereby lowering the forward end 156 of the locking lever so that it can move forwardly unobstructed by the coin return bracket. Upon reaching the forward extent of its travel, the forward end 156 of the locking lever 144 engages a coin release lever (not shown) which releases the coins in the coin control mechanism so that they drop through a hole 163' formed in the locking lever and fall into a coin box (not shown) below.

Attached to the rear end 164 of the locking lever 144 is a bracket 166 having a downwardly projecting tab 168. Attached to the puller cart 70, adjacent the bracket 132, is a bracket 170 having an upwardly projecting flange 172 (FIG. 6) and a slot 174 (FIG. 3) formed in the bracket. When the puller cart 70 and the locking lever 144 are both in their most rearward positions (FIG. 4), the tab 168 projects downwardly through the slot 174 and thereby engages the bracket 170. It will therefore be appreciated that forward movement of the puller cart 70 is prevented if substantial forward movement of the locking lever 144 is also prevented because movement of the locking lever is obstructed by the coin return bracket of the coin control mechanism 14 when the lever is in the orientation shown in FIG. 4. It should be understood that a limited amount of forward travel of the locking lever 144 is possible and desirable. The limited forward travel of the locking lever 144 causes the forward end 156 of the locking lever to contact and actuate the coin return bracket which causes coins in the coin control mechanism 14 to be rejected by the mechanism and returned via a coin return slot (not shown) to the purchaser. However when the forward end 156 of the lever 144 has been cammed downwardly such that substantial forward movement of the lever is permitted, the cart 70 can then also move forward.

The forward movement of the cart 70, when the tab 168 is engaged with the bracket 170, causes the locking lever 144 to slide forward. As the locking lever 144 slides forward, the shaft 154 is guided in the slot 150. As the forward motion continues, the rear end 164 of the locking lever 144 is raised upwardly by the shaft 154 following the upwardly angled portion of the J-shaped slot 150. When the locking lever 144 has reached its forwardmost point of travel, the rear end 164 of the lever has been raised upwardly sufficiently to disengage the tab 168 from the bracket 170. It will therefore be appreciated that although further forward motion of the locking lever 144 is not possible, the puller cart 70 can continue its forward motion. Upon rearward motion of the puller cart 70, the flange 172 catches on the tab 168 thereby returning the locking lever 144 to its original position and reengaging the tab in the slot 174 in the bracket 170. Thus, it will be appreciated that forward motion of the puller cart 70 is prevented unless and until the proper amount of coins have been inserted into the coin control mechanism 14 so that the locking lever 144 is cammed downward upon forward motion thereof.

Pivotally attached to the frame 74 adjacent the track 76 is a display paper release mechanism. An elongate, hollow, generally rectilinearly shaped member 176 is pivotally attached to brackets 178 by a shaft 180. Slidably disposed in the forward end 182 of the member 176 is an L-shaped bracket 184. One end of the bracket 184 is connected (not shown) to one end of a sheathed cable 186, such as the type typically used in association with bicycle hand brakes. A pin 188, projecting downwardly from the forward end 182 of the member 176 and best seen in FIG. 8, passes through a hole 189 formed in the frame 74 and the tray 40 so that the pin can project below the lower surface 118 of the tray. When there is a paper on the platform 28 and the paper is pushed up into contact with the lower surface 118 of the tray 40, the pin 188 rests on the paper. When the member 176 is in such an orientation, the forward end 182 of the member is elevated sufficiently high so that the bracket 184 does not contact a flange 190 (FIG. 3) on the cart 70 as the cart is pulled forward. However, when no paper is on the platform, the pin 188 can drop down to lower the forward end 182 of the member 176 so that the flange 190 contacts the bracket 184 and pulls it forward. As the bracket 184 is pulled forward, the cable 186 withdraws a spring loaded latch 192 of a latching mechanism 194 connected to the other end of the cable.

Figure 5:
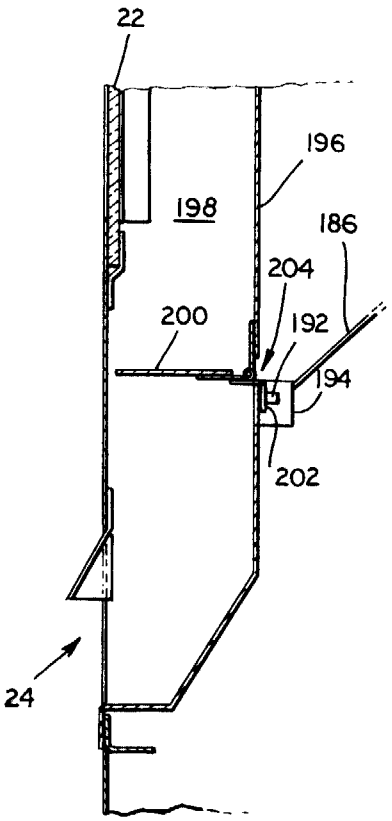
FIG. 5 is a detailed cross-sectional view of the door assembly shown in FIG. 1.

The latching mechanism 194 is disposed on a panel 196 (FIG. 5) attached to the inside of the enclosure 12 behind the window 22. The window 22 and the panel 196 define a space 198 into which a display paper (not shown) may be placed so as to show through the window. The display paper is retained in the space 198 by a hinged bracket 200 attached to the panel 196. A flange 202 attached to the bracket 200 projects through a hole 204 formed in the panel 196 and engages the latch 192 of the latch mechanism 194. When the flange 202 is engaged by the latch 192 the bracket 200 is maintained in a position substantially perpendicular to the panel 196, thereby supporting the display paper in the space 198. When the latch 192 is withdrawn into the latch mechanism 194, due to forward motion of the bracket 184, the latch disengages the flange 202 and permits the bracket 200 to fall under the weight of the display paper. The bracket 200 assumes a position substantially parallel to the panel 196 and permits the display paper to fall from the space 198 and to be dispensed out the slot 24 formed in the enclosure 12. A U-shaped spring 206 (FIG. 1) attached to the outside of the enclosure 12 immediately below the slot 24 catches the display paper as it is dispensed from the slot, so that the paper will not fall on the ground.

Suitable locks 208, 210 are provided on the coin control mechanism 14 and a door 212 in the enclosure 12 so as to permit only authorized access to the coin box and the chamber 26 containing the stack of newspapers.

Operation of the vending apparatus 10 will now be considered. The apparatus 10 is typically, though not exclusively, placed on sidewalks or other similar unattended locations. The apparatus 10 is periodically serviced by the operator of a delivery truck, whereupon a new or different edition of a newspaper is placed in the apparatus.

The operator has in his possession the hand crank which engages the shaft 60. The operator unlocks the lock 210, opens the door 212, and inserts the crank handle through the hole 63 in the enclosure 12 so as to engage the shaft 60 and pins 64. He then engages the pawl 68 so that it acts as a ratchet. The operator turns the crank handle to lower the platform 28 toward the bracket 38. If there are any unsold papers still on platform 28 they are removed and replaced with new or different ones. The new newspapers are placed on the platform in a stack with the folded edge of the newspaper toward the rear of the enclosure 12, i.e., adjacent the wall 86. The operator then disengages the pawl 68 and permits the platform 28 to move upwardly so that the top newspaper of the stack of newspapers on the platform is pressed into contact with the lower surface 118 of the tray 40 and the friction pads 120–126. The operator then removes the hand crank.

Depending on the thickness of the newspaper, the screw pin 128 may require adjustment. Relatively thick and, therefore, heavy papers require more frictional contact with the friction pads 120–126 to be dispensed; whereas, thinner and lighter papers require somewhat less frictional contact. Therefore, for thicker papers the screw pin 128 is rotated so that the tip 129 is retracted with respect to the friction pads 120–126; for thinner papers the tip 129 is extended somewhat. Such adjustments are typically made at the factory to meet anticipated customer requirements.

If the display paper has not been sold, the operator removes the old paper from the space 198 and replaces it with a new one, preferably with the folded edge down against the bracket 200. If the display paper has been sold, the operator must first return the bracket 200 to the perpendicular position so that the flange 202 engages the latch 192. The new paper may then be inserted into the space 198. The operator then closes and locks the door 212. If the operator is authorized, he may also collect the coins from the coin box by unlocking the lock 208 and opening the coin control mechanism 14. After the coins are removed, the coin box is replaced and the coin control mechanism 14 is relocked. The apparatus 10 is then ready to vend newspapers.

It will be assumed that the coin control mechanism 14 has been adjusted to accept a desired amount of coins. A potential customer approaches the apparatus 10 and inserts the required coins into coin slots in the coin control mechanism 14. When the coin control mechanism 14 determines that the proper amount of coins has been inserted therein, it passes the coins therethrough and positions them properly to engage the cam surface 163 of the locking lever 144 so that the locking lever is cammed downwardly upon forward motion thereof, thereby permitting substantial forward motion of the locking lever.

The purchaser then grasps the handle 16 with his hand and pulls it out as far as it will go. As he is pulling the handle 16, the friction pads 120–126 frictionally pull the top paper of the stack of papers on the platform 28 along with the movement of the puller cart 70. The paper is thereby dispensed out of the slot 18. A suitably hinged flap (not shown) is provided in the slot 18 permitting the paper to be dispensed therethrough, but preventing reaching into the chamber 26 with the hand to grasp and withdraw unpaid-for papers.

When the handle 16 has been pulled forward to its fullest extent, the forward end 156 of the locking lever 144 engages the coin release bracket which causes the coins to be released from the coin control mechanism 14 and dropped through the hole 163' into the coin box.

Had the improper amount of coins been inserted into the coin control mechanism 14, pulling of the handle 16 would permit only limited forward movement of the locking lever 144 and its forward end 156 would engage the coin return bracket and return the coins through the coin return slot. Further forward motion of either the locking lever 144 or the cart 70 is prevented.

During the operation described above the bracket 184 does not contact the flange 190 of the cart 70, because the pin 188 is resting on the top paper of the stack of papers on the platform 28. However, when the last paper on the platform 28 has been sold, the member 176 and pin 188 drop down. The purchaser observing the apparatus 10 does not observe any difference in the outward appearance of the apparatus. He inserts his coins and pulls the handle 16 in the same manner described above. However, at the end of the outward stroke of the handle 16, the puller cart 70 is pulled forwardly sufficiently far so that the flange 190 pulls the bracket 184 outwardly a sufficient amount to retract the latch 192 into the latch mechanism 194. When the latch 192 is thusly withdrawn, it disengages the flange 202 allowing the bracket 200 to drop and dispense the display paper out the slot 204 by gravity flow.

After the proper amount of coins have been inserted in the coin control mechanism 14 and forward movement of the puller cart 70 begins, incremental forward and backward movement of the puller cart in an attempt to dispense more than one paper at a time is prevented by the two-way ratchet system. Therefore, it is impossible to dispense more than one paid for paper at a time. Theft of papers is thereby prevented.

It should be understood, of course, that the foregoing relates to only a preferred embodiment of the present invention and that numerous modifications or alterations may be made therein without departing from the spirit and scope of the invention as set forth in the appended claims.

We claim:

1. Apparatus for vending papers singly, said apparatus comprising:

means for enclosing a plurality of said papers, said enclosure means having a longitudinal axis, a lateral axis, an upper portion, a lower portion, and a dispensing slot in said upper portion;

platform means movable parallel to said longitudinal axis of said enclosure means for stacking said plurality of papers thereon;

means for urging said platform means from said lower portion toward said upper portion of said enclosure means;

cart means movable parallel to said lateral axis of said enclosure means, said cart means being disposed in said upper portion of said enclosure means, said cart means having a first position and a second position;

means operatively associated with said cart means for moving said cart means from said first position to said second position when said means is manually actuated;

means for urging said cart means from said second position toward said first position;

means attached to said cart means for selectively engaging a top paper of said stack of papers disposed adjacent said cart means such that said engaging means dispenses said top newspaper out of said dispensing slot as said cart means is moved from said first position to said second position and said engaging means does not engage a top paper as said cart means is moved from said second position to said first position;

window means for displaying a newspaper disposed therebehind; and means for selectively retaining said newspaper behind said window means, said retaining means having a first position whereby said newspaper is retained behind said window means and a second position whereby said newspaper is dispensed by gravity feed from a slot formed in said enclosure means below said window means, said retaining means being operable in response to movement of said cart means such that said retaining means is maintained in said first position when papers are stacked on said platform means and said retaining means is in said second position when no papers are stacked on said platform means and said cart means is in said second position.

2. The apparatus of claim 1 further comprising means for retaining said cart means in said first position until a desired amount of coins has been deposited in a coin control mechanism.

3. The apparatus of claim 1 further comprising ratchet means operative with said cart means to limit the amount and direction of movement of said cart means.

* * * * *